US009492906B2

(12) United States Patent
Rösing et al.

(10) Patent No.: US 9,492,906 B2
(45) Date of Patent: Nov. 15, 2016

(54) CLEANING OF A TURBO-MACHINE STAGE

(75) Inventors: Jürgen Rösing, Sehnde (DE); Frank Seidel, Isernhagen H.B. (DE); Lutz Winkler, Wunstorf (DE); Bernd Kriegl, Olching (DE); Thomas Uihlein, Dachau (DE); Martin Dürr, München (DE); Fabian Moritz, München (DE)

(73) Assignee: MTU AERO ENGINES GMBH, Munich (DE)

( * ) Notice: Subject to any disclaimer, the term of this patent is extended or adjusted under 35 U.S.C. 154(b) by 634 days.

(21) Appl. No.: 13/813,919

(22) PCT Filed: Aug. 3, 2011

(86) PCT No.: PCT/DE2011/001545

§ 371 (c)(1),
(2), (4) Date: Mar. 27, 2013

(87) PCT Pub. No.: WO2012/025090

PCT Pub. Date: Mar. 1, 2012

(65) Prior Publication Data

US 2013/0174869 A1 Jul. 11, 2013

(30) Foreign Application Priority Data

Aug. 3, 2010 (DE) ..... 10 2010 033 157
Sep. 17, 2010 (DE) ..... 10 2010 045 869

(51) Int. Cl.

| | |
|---|---|
| ***B08B 7/00*** | (2006.01) |
| ***B24C 1/00*** | (2006.01) |
| ***B08B 9/00*** | (2006.01) |
| ***B24C 1/08*** | (2006.01) |

(Continued)

(52) U.S. Cl.

CPC ..... *B24C 1/003* (2013.01); *B08B 7/0021* (2013.01); *B08B 9/00* (2013.01); *B24C 1/086* (2013.01); *B24C 3/325* (2013.01); *F01D 25/002* (2013.01)

(58) Field of Classification Search

None

See application file for complete search history.

(56) References Cited

U.S. PATENT DOCUMENTS 3,074,822 A * 1/1963 Walk et al. ..... 134/7
3,778,170 A * 12/1973 Howell et al. ..... 356/241.4

(Continued)

FOREIGN PATENT DOCUMENTS

DE 102008011108 A1 8/2009
DE 102008019892 A1 10/2009

(Continued)

OTHER PUBLICATIONS

PCT: International Search Report and Written Opinion of PCT/DE2011/001545; Mar. 19, 2012; 13 pages (only the ISR is translated).

(Continued)

*Primary Examiner* — Binh X Tran
*Assistant Examiner* — David Cathey, Jr.
(74) *Attorney, Agent, or Firm* — Howison & Arnott, L.L.P.

(57) ABSTRACT

The invention relates to a method for cleaning a turbo-machine stage (100) consisting of at least one of the following steps: a cleaning nozzle (1) is introduced into an opening of a turbo-machine, in particular into an inspection opening (220); and the blade (100) of the stage is acted upon by solid particles, said particles subliming at the blade temperature, in particular into dry ice particles.

15 Claims, 1 Drawing Sheet

(51) Int. Cl.
*B24C 3/32* (2006.01)
*F01D 25/00* (2006.01)

(56) References Cited

U.S. PATENT DOCUMENTS 5,679,174 A * 10/1997 Buongiorno ..... B08B 3/02 134/1
6,059,522 A * 5/2000 Gertz et al. ..... 415/1
6,883,527 B2 * 4/2005 Travaly ..... B08B 9/00 134/169 R
2002/0086616 A1 * 7/2002 Tomlinson ..... B24C 1/003 451/39
2008/0216873 A1 9/2008 Hjerpe
2010/0000572 A1 1/2010 Giljohann
2010/0159814 A1 * 6/2010 Corn ..... B24B 19/009 451/552

FOREIGN PATENT DOCUMENTS

WO 2005120953 A1 12/2005
WO 2009106042 A1 9/2009
WO 2009132847 A1 11/2009

OTHER PUBLICATIONS

German Patent and Trademark Office; Office Action for related application DE 10 2010 045 869.4; May 30, 2012; 4 pages.

* cited by examiner

CLEANING OF A TURBO-MACHINE STAGE

CROSS-REFERENCE TO RELATED APPLICATIONS

This application is a U.S. National Phase application submitted under 35 U.S.C. §371 of Patent Cooperation Treaty application serial no. PCT/DE2011/001545, filed Aug. 3, 2011, and entitled CLEANING OF A TURBO-MACHINE STAGE, which application claims priority to German patent application serial no. 10 2010 033 157.0, filed Aug. 3, 2010, entitled REINIGUNG EINER TURBOMASCHINENSTUFE and German patent application serial no. 10 2010 045 869.4, filed Sep. 17, 2010, entitled REINIGUNG EINER TURBOMASCHINENSTUFE.

Patent Cooperation Treaty application serial no. PCT/DE2011/001545, published as WO 2012/025090, German patent application serial no. 10 2010 033 157.0, and German patent application serial no. 10 2010 045 869.4, are incorporated herein by reference.

TECHNICAL FIELD

The invention relates to a method for cleaning a machine stage of a gas turbine as well as to the use of a cleaning nozzle in such a method.

BACKGROUND

Impurities, for example, sand, dust, volcanic ash, sea or fertilizer salt, chemicals, oil, lubricants and the like are deposited on the blades of the individual compressor and turbine stages of airplane engine gas turbines, and adhere there, becoming encrusted in particular, so that the airplane engine is negatively affected. This is also referred to as "fouling."

From the category-defining WO 2005/120953 A1, it is known to spray a liquid cleaning agent, particularly water with or without additives, into the engine from the front, in order to remove these foreign materials mechanically and chemically.

The disadvantage here is, on one hand, that the soiled cleaning agent has to be discarded after use by means of a separate collection device, and, on the other hand, the engine stages, particularly turbine stages, located further downstream cannot be acted on optimally.

The present invention is based on the problem of improving the cleaning of a turbo-machine stage and reducing at least one of the above-mentioned disadvantages. The term turbo-machine stage denotes both a compressor stage and also a turbine stage.

SUMMARY AND DESCRIPTION

The aforementioned problem is addressed by a method having the characteristics described and claimed herein. A cleaning nozzle designed for this purpose is described in addition to the use of said nozzle. Advantageous variants of these methods and apparatus are also described and claimed.

According to a first aspect of the present invention, a blade of a machine stage to be cleaned is acted upon, sprayed in particular, by solid particles which sublime at the blade temperature. The blade temperature here denotes the temperature, in particular the minimum temperature, of the blade during the cleaning, and subliming denotes, as is customary in the field, the at least substantially direct transition from the solid phase to the gas phase.

It is advantageous that due to sublimation less or no liquid wastes have to be discarded. On the other hand, the sudden sublimation as well as the thermal shock can be used advantageously in addition to the kinetic energy in order to clean the blades.

In a preferred embodiment, the acting solid particles comprise dry ice or are dry ice particles. Dry ice, i.e., frozen carbon dioxide ($CO_{2(s)}$) undergoes a transition at normal pressure of approximately 1 bar and at approximately −78° C. from the solid phase to the gas phase ($CO_{2(g)}$). After the cleaning, it escapes as a harmless component of the air into the environment. Considering this preferred embodiment, it becomes clear that the sublimation temperature, particularly the triple point, of the solid particles can also be lower than the blade temperature, as long as the solid particles (also still) sublime at the blade temperature.

The solid particles can be applied to the blades in a gas jet, for example, as a dry ice jet, or as a finely distributed solid snow, for example, a $CO_2$ snow. The particles of a dry ice jet, which are obtained from "solid CO2," typically have a higher density and as a result they produce a stronger mechanical attack against the soiling. On the other hand, $CO_2$ snow (produced from compressed $CO_2$ gas) has a gentler action. Furthermore, additional media (hard particles) can be introduced into the dry ice, in order to increase the cleaning effect.

According to a second aspect of the present invention, which can preferably be combined with the above explained first aspect, a cleaning nozzle is inserted between a machine stage to be cleaned and an adjacent machine stage of a multistage turbo-machine. The nozzle is used to cause a cleaning agent, in particular the above explained solid particles, to act on the blades of the stage to be cleaned. For this purpose, in a preferred embodiment, inspection openings can be used which, in airplane engines, for example, are provided anyway for the boroscope inspection of the stage(s). Similarly, it is also possible to provide special cleaning openings for the introduction of the cleaning nozzle, in particular already at the time of the manufacture of the turbo-machine, or only at a later time. Other openings that are not used primarily for the inspection can also be used for the cleaning, such as, for example, openings for fuel nozzles or spark plugs. If, in a preferred embodiment, the cleaning nozzle is introduced into a flow channel in which the blades of the stage to be cleaned are arranged as rotor blades or stator blades, it is particularly advantageous to close the opening(s) through which the cleaning nozzle is introduced for the cleaning again in a fluid-tight manner after the cleaning, for example, by screwing in a plug which, in a preferred variant, is attached in a loss-proof manner on the turbo-machine and removed temporarily for the cleaning.

Due to the introduction of at least one cleaning nozzle in between at least one turbo-machine stage, the latter can be cleaned in a more targeted and direct manner than by the injection of water from a turbo-machine intake. It is also possible to introduce several nozzles into different openings, so that several stages are cleaned simultaneously and/or a single stage is cleaned more rapidly. In the process it is possible to arrange several openings on or in the vicinity of a stage over the periphery.

The first and/or second aspects are used to particularly great advantage in compressor or turbine stages, particularly high-pressure compressor or turbine stages, of gas turbines, particularly of airplane engines, in order to clean the rotor and/or stator blades of this (these) stage(s).

According to a preferred embodiment of the present invention, the turbo-machine stage is rotated manually and/ or motor-driven in situ during the cleaning, preferably at a speed of rotation of 1-10 rotations per minute (rpm), particularly 5 rpm, and particularly preferably 3 rpm. For the manual rotation, it is preferred to attach a suitable lever detachably to the turbo-machine or to the rotor comprising the stage to be cleaned. A motor-driven rotation can occur similarly by a drive system of the turbo-machine, for example, a starter motor, or by a separate drive system attached detachably to the turbo-machine or to the rotor comprising the stage to be cleaned. In situ refers particularly to the installed and/or at least substantially assembled turbo-machine, for example, as the airplane engine that is attached to the airplane or also industrial gas turbines (IGT), and/or at least substantially non-disassembled, airplane engines or IGTs. However, disassembled modules can also be cleaned.

In a preferred embodiment, the cleaning nozzle is radially displaced manually and/or motor-driven, in order to clean a blade preferably over its entire radial length or a (particularly) soiled radial area, for example, at the blade head or foot. In order to simplify the manual displacement, the cleaning nozzle can have radially spaced markings or gratings. The motor-driven displacement, for example, by means of a linear motor or a rotation motor with corresponding gear mechanism, can—like manual displacement—occur continuously or in discrete sections, particularly in a rasterized manner.

According to an embodiment, the radial displacement occurs during a rotation of the turbo-machine stage. In the process, the cleaning nozzle is secured in a radial position, and the turbo-machine stage is rotated at least once in such a manner that all the blades are moved past the cleaning nozzle. If only one cleaning nozzle is provided for cleaning the stage, the turbo-machine stage is thus rotated at least once completely, i.e., by 360°, whereas if two or more cleaning nozzles are provided, the turbo-machine stage is rotated accordingly by at least 360° divided by the number of the cleaning nozzles. Subsequently, the cleaning nozzle is displaced in a radial direction, and the turbo-machine stage is again rotated at least once in such a manner that all the blades are moved past the cleaning nozzle.

Similarly, the radial displacement can also occur after a rotation of the turbo-machine stage. In the process, a blade is first cleaned, in that the cleaning nozzle, when the stage is not rotating, is radially displaced, and in the process sweeps over the area to be cleaned, preferably at least substantially the entire blade. Subsequently, the turbo-machine stage is further rotated, until the cleaning nozzle sweeps over another, particularly the adjacent, blade, and repeats the radial displacement, preferably in the opposite direction, in order to minimize the travelling distance of the cleaning nozzle which thus preferably moves over one blade radially from the inside toward the outside, and over the next blades radially from the outside toward the inside. Here too, it is of course possible to provide several cleaning nozzles, wherein the turbo-machine stage is then preferably further rotated, until all the cleaning nozzles sweep over another, particularly an adjacent blade. Thus, for example, if two cleaning nozzles are associated in the peripheral direction with two adjacent blades, the turbo-machine stage is further rotated by two blade separations.

According to a preferred embodiment of the present invention, a jet outlet direction of the cleaning nozzle or a jet outlet direction of the action delivery, comprises particularly an at least substantially constant, radial and/or peripheral component. It is particularly advantageous for the jet outlet direction to form an angle with an axial direction of the turbo-machine of 10-20°. This angle can be set variably. In the peripheral direction, the jet outlet direction is preferably at least substantially oriented like a flow of the work fluid during the operation of the turbo-machine, so that, for example, the rotor blades of a compressor or turbine stage are acted upon preferably substantially with the flow exposure angle of the design. This is gentle particularly for the turbo-machine stage. Moreover, the cleaning nozzle can comprise several nozzle openings, wherein at least one nozzle opening can be opened or closed by a gate valve.

In particular, if, according to the first aspect of the present invention, a blade of a turbo-machine stage to be cleaned is acted upon by solid particles which sublime at the blade temperature, it is preferred for the blade temperature during the cleaning to be higher, particularly by at least 10° C., than the environmental temperature. In a preferred embodiment, this can be achieved by residual heat of the turbo-machine, particularly of an airplane engine and/or by an additional heating device which, for example, heats the turbo-machine stage directly, for example, by induction, or by heat conduction, or indirectly, particularly by convection or by heat transmission or transfer. In addition or alternatively, the blade temperature preferably also has an upper limit, and in a preferred embodiment, it is at most 170° C., preferably at most 150° C.

A solid particle mass flow of at least 0.1 kg/min, preferably at least 0.6 kg/min and/or at most 1.0 kg/min, preferably at most 0.7 kg/min in itself has been found to be particularly advantageous. Here, it is preferred for the cleaning jet, particularly the compressed air of a dry ice jet, to have a pressure of 4-10 bar.

In order to shorten the cleaning time, it can be advantageous, as already explained, to introduce several cleaning nozzles and/or act upon several blades and/or stages at the same time. Two cleaning nozzles here can act similarly on different blades of the same stage or blades of different stages. This depends particularly on the cleaning or inspection openings through which the cleaning nozzles are introduced. It can be advantageous for the inspection or cleaning openings or the cleaning nozzles introduced into the latter to be mutually offset in the peripheral direction in different stages, so that a cleaning agent that flows past a blade additionally hits axially adjacent blades which at that time are not acted upon. Similarly, it can be advantageous if the inspection or cleaning openings or the cleaning nozzles introduced into the latter are not mutually offset in the peripheral direction in different stages, so that the access is simplified over the axial length of the turbo-machine. In the case of several cleaning nozzles for one stage, it is possible to provide that each blade is acted upon only by the same nozzle, so that all the blades are already swept over in the case of a rotation by 360° divided by the number of the cleaning nozzles. Similarly, it is possible to provide that each blade is acted upon by different nozzles, so that the cleaning action is increased. For example, if two cleaning nozzles are arranged with mutual offset by the blade separation in the peripheral direction, the stage can be further rotated, on the one hand, by twice the blade separation, so that each $n^{th}$ blade is acted upon by the first, and each $(n+1)^{th}$ blade by the second cleaning nozzle. Similarly, the stage can be further rotated by the blade separation, so that each blade is acted upon by the first and then by the second cleaning nozzle.

A cleaning nozzle provided for the cleaning according to the invention of a turbo-machine stage, according to a preferred embodiment of the present invention, comprises at least partially a stick-slip coating which comprises particularly MoSi2 and/or PTFE, in order to prevent freezing of the operation. This coating can be applied particularly as a lacquer or as a shrunk-on hose.

In addition or alternatively, at least one radially front portion of the cleaning nozzle can be produced from a material, particularly aluminum or an aluminum alloy, which is softer than the turbo-machine stage, in order to minimize in this manner damage to the stage during an unwanted contact with the cleaning nozzle. In particular, a material in the sense of the present invention is softer than another material, if its Brinell, Vickers or Rockwell hardness or the hardness determined according to another method is at least 10% lower than that of the other material.

In addition or alternatively, the cleaning nozzle can comprise a contact protection. The latter consists particularly of a softer material than the turbo-machine stage and it can be arranged particularly in an annular manner on a radially front partial area of the cleaning nozzle.

According to a preferred embodiment of the present invention, the cleaning nozzle comprises a guide pipe in which an inner pipe with a nozzle opening is shiftably arranged. Said cleaning nozzle makes it possible to introduce the guide pipe into the turbo-machine and secure it there, wherein the radial displacement of the cleaning nozzle takes place by a displacement of the inner pipe in the guide pipe. As explained above, the displacement can occur manually or be motor-driven, and continuously or discretely. For this purpose, for example, the inner pipe can have markings or gratings, or a drive system can displace the inner pipe in the guide pipe.

According to a preferred embodiment of the present invention, the cleaning nozzle comprises particularly a screwable guide means for the detachable securing to the turbo-machine. Such a guide means can comprise, for example, a screw-in sleeve or a screw thread which is screwed in particular into an inspection or cleaning opening in the turbo-machine, and which fixes the above explained guide pipe axially and rotationally thereto.

According to a preferred embodiment of the present invention, the cleaning nozzle has one or more handles for thermal insulation, to protect the user from the cold of the dry ice.

DESCRIPTION OF FIGURES

Additional characteristics and advantages result from the dependent claims and the embodiment example. Moreover, in a partially diagrammatic representation:

DETAILED DESCRIPTION

Figure 1:
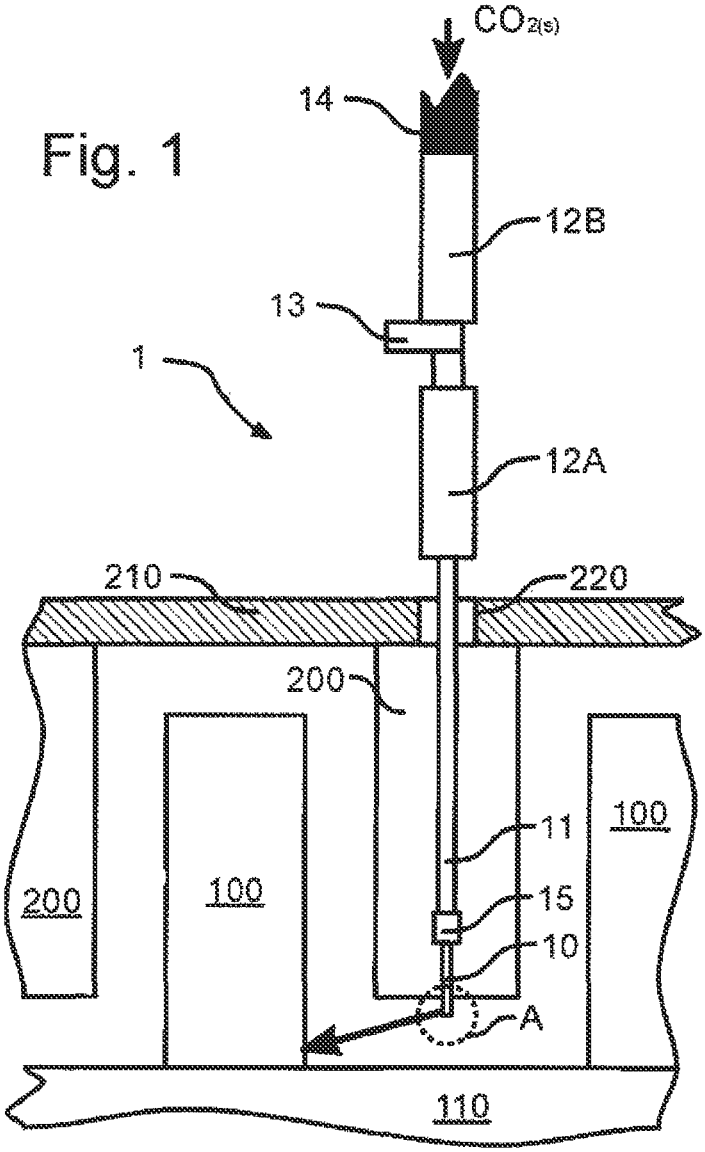
FIG. 1 shows a partial section of an airplane engine with a cleaning nozzle for cleaning which is inserted between two stages, according to an embodiment of the present invention.

FIG. 1 shows a portion of a high-pressure compressor or a high-pressure turbine of an airplane engine in an axial cross section with several stages each comprising rotor blades 100 and stator blades 200.

Figure 2:
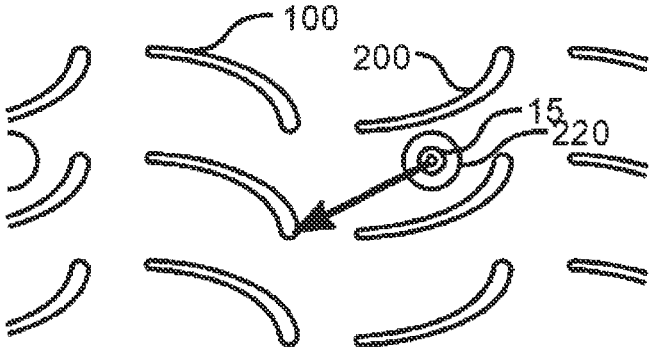
FIG. 2 shows the portion of the airplane engine of FIG. 1 in a developed view in the peripheral direction.

Between two stator blades of a stage, as one can see particularly in FIG. 2, an inspection opening 220 is provided in the flow channel and engine outer wall 210, which can be closed in a detachable manner by a plug (not shown, because removed in FIGS. 1, 2).

Through this opening 220, a cleaning nozzle 1 is introduced. It comprises a guide pipe 11 made of a steel or aluminum alloy with two thermally insulating handles 12A, 12B and a detachable clamp 13, as well as an inner pipe 10 which can be displaced in the guide pipe 11, and on the front face of which, facing away from the handles, nozzle opening 16 is arranged, which is represented in detail in FIG. 3. This clamp 13 can be designed as a rubber fixation and/or as a magnet. Furthermore, the inner pipe 10 can be made of Nitinol and/or it can be flexible. On the radially front marginal area of the inner pipe 11 produced from an aluminum alloy an annular contact protection 15 made of soft aluminum is arranged.

To the cleaning nozzle 1, a hose 14 is connected through which a dry ice jet, i.e., compressed air, entrains and supplies the dry ice particles, and is sprayed through the nozzle opening 16 of the cleaning nozzle 1 onto the rotor blades 100. Instead of such a dry ice jet, a $CO_2$ snow jet with finer, crystalline dry ice particles can also be used. Both can be removed from a reservoir or produced, for example, by a scrambler as needed.

For the cleaning, the cleaning nozzle 1 is introduced through the inspection opening 220, and the guide pipe 11 is secured manually or by the clamp 13 to the turbo-machine. The inner pipe 10 can be displaced axially, but it is guided in a rotationally fixed manner in the guide pipe 11, so that the angular position of the guide pipe 11 on the turbo-machine also defines the angular position of the inner pipe 10 relative to the rotor blade 100 and stator blade 200.

The inner pipe is successively led into different radial (vertical in FIG. 1) indexed positions and maintained there. Then, the rotor 110 of the engine is rotated at a speed of rotation of approximately 1-3 rpm in each case by at least 360°, while dry ice through the nozzle opening 16 of the cleaning nozzle 1 acts on the rotor blades 100 that rotate past, as indicated in FIGS. 1, 2 by the flow arrows of the dry ice or $CO_2$ snow jet. If all the blades 100 at this radial height have been cleaned, then the inner pipe 10 is guided into the next radial indexed position, which can be provided, for example, by markings, and maintained there, and subsequently the rotor 110 is again rotated by at least 360°. This process is repeated until all the blades of the stage have been cleaned in the desired radial area, preferably over their entire channel height.

The rotor 110 can also be rotated repeatedly by a radial displacement of the inner pipe in order to act repeatedly on the blades in the same radial range, and thus clean them more thoroughly. Similarly, it is also possible to clean a blade by radial displacement of the inner pipe 10, before the rotor 110 has further rotated by one blade separation, and in this manner the next blade in the peripheral direction is cleaned.

Figure 3:
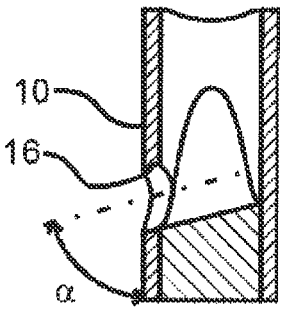
FIG. 3 shows the detail marked "A" in FIG. 1 in an enlarged representation.

One can see in FIGS. 1, 3 that the jet outlet direction, in which the dry ice $CO_2$ snow jet exits from the nozzle opening 16 and acts on the rotor blades 100, is slanted against the axial direction (horizontal in FIGS. 1-3) by an angle $\alpha$ which is approximately 15°. In the peripheral direction as well, the jet outlet direction, as can be seen in FIG. 2, is inclined against the axial direction, so that the dry ice and/or $CO_2$ snow jet and/or liquid $CO_2$ hits the rotor blades at approximately the orientation that the work fluid also has during the operation. In turn, solid and liquid $CO_2$ can then be introduced. These components in the radial and peripheral direction are preferably constant, and they can be set by an appropriate securing of the inner pipe 10 in the guide pipe 11, particularly a rotationally fixed, axially shiftable, mounting, so that an appropriate securing of the guide pipe 11 on the engine wall 210, for example, by markings or an adapter (not shown). On the inner pipe 10 it is preferable to attach a sensor to determine the separation and/or soiling type and/or soiling degree. Accordingly, the radiation parameters, such as, pressure, temperature, particle speed, nozzle number, nozzle diameter and/or rotation angle of the cleaning nozzle, can be set or regulated. To further improve the cleaning effect, a heating device (laser, IR lamp) can be attached on the inner pipe 10, in order to be able to heat the object to be cleaned before the $CO_2$ jets.

To increase or improve the cleaning quality, a gas flow can be led additionally through the engine. To further improve the cleaning quality, it is possible, alternatively or in combination, to subject the engine to a preliminary treatment with an aqueous and/or chemical solution and/or acid.

It is also possible to use this method according to the invention and the described device for cleaning engine pods, lines (to remove coking and oil carbon), the gas path, bearings, bearing chambers, and shafts. For this purpose, the nozzle opening 16 can be directed substantially radially toward the inside. The combustion chamber can thus also be cleaned. For this purpose, at least one injection nozzle is removed, and at least one cleaning nozzle as described here is introduced into the opening that has been uncovered.

For cleaning clogged cooling air bores, for example, of high-pressure turbine rotor blades, it is preferable to use a high-speed nozzle opening (Laval nozzle). An additional advantageous idea is to fill the engine completely or at least to a certain level with cleaning medium ($CO_2$). After the filling, the shaft(s) of the engine is (are) rotated.

If the process parameters described here are increased, then the method can also be used for removing coatings and for stripping paint from components.

The invention claimed is:

1. A method for cleaning a machine stage of a gas turbine, the gas turbine including a plurality of machine stages, each machine stage including a rotor and a plurality of blades, the rotor being rotatable around a rotor axis defining an axial direction parallel to the rotor axis and a radial direction perpendicular to the rotor axis, the blades being radially oriented and mounted on the rotor and configured to revolve around the rotor axis, the method comprising the following steps:

providing a sublimable material, wherein the sublimable material is dry ice;

introducing a cleaning nozzle through an opening in an outer wall of the gas turbine and into the machine stage, the cleaning nozzle including, an elongated guide pipe extending radially into the machine stage, an inner pipe shiftably arranged within the guide pipe, the inner pipe being rotationally fixed within the guide pipe and the inner pipe also being longitudinally displaceable within the guide pipe so as to be radially movable with respect to the machine stage, and a nozzle opening disposed on a lateral face of the radially inward end of the inner pipe, the nozzle opening being rotationally fixed on the inner pipe to define a jet outlet direction; and acting on the blades of the machine stage by directing a jet including solid particles of the sublimable material from the nozzle opening of the cleaning nozzle in the jet outlet direction against the blades.

2. A method in accordance with claim 1, wherein the solid particles are dry ice particles ($CO_{2(s)}$).

3. A method in accordance with claim 1, wherein the opening in the outer wall is arranged between the turbo-machine stage to be cleaned and an adjacent turbo-machine stage.

4. A method in accordance with claim 1, wherein the turbo-machine stage is rotated, either manually and/or by motor-drive, in situ during the cleaning.

5. A method in accordance with claim 4, wherein the cleaning nozzle is radially displaced, either manually and/or by motor-drive, during a rotation of the turbo-machine stage.

6. A method in accordance with claim 4, wherein the cleaning nozzle is radially displaced, either manually and/or by motor-drive, after a rotation of the turbo-machine stage.

7. A method in accordance with claim 1, wherein each cleaning nozzle delivers the solid particles acting on the blade at a mass flow within the range from 0.1 kg/min to 1.0 kg/min.

8. A method in accordance with claim 7, wherein each cleaning nozzle delivers the solid particles acting on the blade at a mass flow within the range from 0.6 kg/min to 0.7 kg/min.

9. A method in accordance with claim 1, wherein a plurality of cleaning nozzles are introduced through openings in the outer wall of the gas turbine simultaneously and:

a plurality of blades in a single machine stage are acted upon simultaneously; and/or at least one blade in each of a plurality of machine stages are acted upon simultaneously.

10. A method in accordance with claim 1, wherein the cleaning nozzle further comprises at least one of:

a radially front portion produced from a material that is softer than the material of the turbo-machine stage; and/or a stick-slip coating that comprises at least one of MoSi2 and PTFE; and/or an annular contact protection member.

11. A method in accordance with claim 1, wherein the cleaning nozzle further comprises a handle for thermal insulation.

12. A method in accordance with claim 1, wherein:

the guide pipe is rotationally secured to the gas turbine to define a first angular position of the guide pipe relative to the axial direction;

the first angular position of the guide pipe relative to the axial direction also defines a second angular position of the inner pipe relative to the axial direction; and the second angular position of the inner pipe relative to the axial direction also defines, when viewed in the radial direction along the inner pipe, a first offset angle of the jet outlet direction relative to the axial direction, the first offset angle having a constant value.

13. A method in accordance with claim 1, wherein the guide pipe is rigid and extends from the outer wall of the gas turbine in the radial direction into the machine stage.

14. A method in accordance with claim 13, wherein the guide pipe is made of a steel or aluminum alloy.

15. A method in accordance with claim 1, wherein the jet nozzle defines, when viewed in a peripheral direction perpendicular to both the axial direction and the radial direction, a second offset angle relative to the axial direction, the second offset angle having a constant value.

* * * * *